US006460961B2

(12) United States Patent
Lee et al.

(10) Patent No.: US 6,460,961 B2
(45) Date of Patent: Oct. 8, 2002

(54) HEATER OF BUBBLE-JET TYPE INK-JET PRINTHEAD FOR GRAY SCALE PRINTING AND MANUFACTURING METHOD THEREOF

(75) Inventors: Chung-jeon Lee, Seoul (KR); Young-chul Kim, Seongnam (KR); Jae-ho Moon, Seoul (KR); Oh-hyun Baek, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/842,184

(22) Filed: Apr. 26, 2001

(65) Prior Publication Data

US 2002/0008734 A1 Jan. 24, 2002

(30) Foreign Application Priority Data

Jul. 24, 2000 (KR) ..... 2000-42366

(51) Int. Cl.[7] ..... B41J 2/205; B41J 2/14; B41J 2/16

(52) U.S. Cl. ..... 347/15; 347/48

(58) Field of Search ..... 347/15, 48, 62, 347/67, 63, 61, 65; 29/890.1

(56) References Cited

U.S. PATENT DOCUMENTS 4,339,762 A * 7/1982 Shirato et al. ..... 347/62
4,965,594 A * 10/1990 Komuro ..... 347/15
5,742,307 A * 4/1998 Watrobski et al. ..... 347/62
6,273,553 B1 * 8/2001 Kim et al. ..... 347/48

* cited by examiner

*Primary Examiner*—Hai Pham
*Assistant Examiner*—Juanita Stephens
(74) *Attorney, Agent, or Firm*—Robert E. Bushnell, Esq.

(57) ABSTRACT

A heater of a bubble-jet type ink jet printhead enabling gray scale and manufacturing method thereof are provided. The heater includes two or more heating elements arranged concentrically around a nozzle. Each of the heating elements is formed in polygonal or annular shape and spaced apart by a different distance from the center of the nozzle. Each heating element is coupled to an electrode for applying heater drive power independently. Thus, the heater drive power is applied to each electrode selectively or in combination, thereby forming bubbles having different volumes.

39 Claims, 7 Drawing Sheets

HEATER OF BUBBLE-JET TYPE INK-JET PRINTHEAD FOR GRAY SCALE PRINTING AND MANUFACTURING METHOD THEREOF

CLAIM OF PRIORITY

This application makes reference to, incorporates the same herein, and claims all benefits accruing under 35 U.S.C. §119 from my application entitled HEATER OF BUBBLE-JET TYPE INK-JET PRINTHEAD ENABLING GRAY SCALE AND MANUFACTURING METHOD THEREOF filed with the Korean Industrial Property Office on Jul. 24, 2000 and there duly assigned Serial No. 42366/2000.

BACKGROUND OF THE INVENTION

1. Field of the Invention

The present invention relates to a heater of a bubble-jet type ink jet printhead, and more particularly, to a heater of a bubble-jet type ink jet printhead for gray scale printing and a manufacturing method thereof.

2. Description of the Related Art

The ink ejection mechanisms of an ink-jet printer are largely categorized into two types: an electro-thermal transducer type (or bubble-jet type) in which a heater consisting of resistive heating elements is used to produce a bubble in ink causing ink drops to be ejected, and an electro-mechanical transducer type in which a piezoelectric crystal bends to change the volume of ink causing ink drops to be ejected. Accomplishing a gray scale, that is, the series of achromatic shades, is one of the major functions of an ink jet printer. Typically, to effect gray scale printing, the volume of ink ejected, i.e., the size of ink droplets is adjusted to affect the size of dots represented on a print sheet.

It is known that a bubble-jet type ink jet printhead has difficulties in accomplishing gray scale printing while it is advantageous over an electro-mechanical transducer in high volume production. Thus, it is highly desirable to have a bubble-jet type ink jet printhead for effecting gray scale printing. What is needed is a design for a bubble-jet type ink jet print head that is easy to manufacture and that can easily produce varying shades of gray by energizing specific ones or a plurality of heaters for each nozzle hole producing ink droplets of varying sizes depending on what combination of heaters are energized.

SUMMARY OF THE INVENTION

To solve the above problems, it is an objective of the present invention to provide a heater and electrode arrangement for a bubble-jet type ink jet printhead adapted to produce gray scale printing more quickly and easily.

It is another objective of the present invention to provide a method of manufacturing the heater.

It is yet another object of the present invention to provide a plurality of heaters for each nozzle hole, allowing one, some, or all of the heaters to be energized during a printing process producing ink droplets of varying sizes depending on which heater or what combination of heaters are energized, resulting in the capability to produce varying shades of gray on a recording medium.

It is still an object of the present invention to be able to provide a variety of bubble-jet type ink jet printhead structures that can accommodate the plurality of heaters for each nozzle hole.

It is further an object of the present invention to provide various locations wherein the plurality of heaters and the corresponding plurality of electrodes can be located for a given bubble-jet type ink jet printhead structure.

It is still yet another object of the present invention to provide a simple and easy method of manufacture of the heater/electrode structure and the bubble-jet type ink jet printhead structure as disclosed in this invention.

Accordingly, to achieve the above objectives, the present invention provides a heater of a bubble-jet type ink jet printhead for enabling gray scale. The heater includes two or more heating elements arranged concentrically around a nozzle. Each of the heating elements is formed in polygonal or circular shape and spaced apart by a different distance from the center of the nozzle. Each heating element is coupled to an electrode for applying heater drive power independently.

Thus, heater drive power is applied to each electrode selectively or in combination to form bubbles having different volumes, thereby ejecting ink droplets in different sizes to effect gray scale printing. Furthermore, gray scale printing is accomplished with one-time application of heater drive power to enable high-speed printing, and thus there is no problem with increasing a drive cycle.

The present invention provides a method of manufacturing a heater according to the invention including the steps of a method of manufacturing a heater of a bubble-jet type ink jet printhead including the steps of: forming a first heating element in the shape of polygonal or circle having a predetermined diameter on a substrate; forming a first electrode for applying heater drive power to the first heating element; forming a second heating element in a circular shape having a diameter larger than that of the first heating element concentrically with the first heating element, or in a polygonal shape; and forming a second electrode for applying heater drive power to the second heating element.

Here, an insulating layer may be interposed between the first heating element and the first electrode and the second heating element and the second electrode thereby electrically insulating them from each other. The first and second heating elements may be formed of the same material thereby electrically connecting to each other. Accordingly, the present invention can provide a heater which simply enables gray scale by applying a typical heater manufacturing method.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
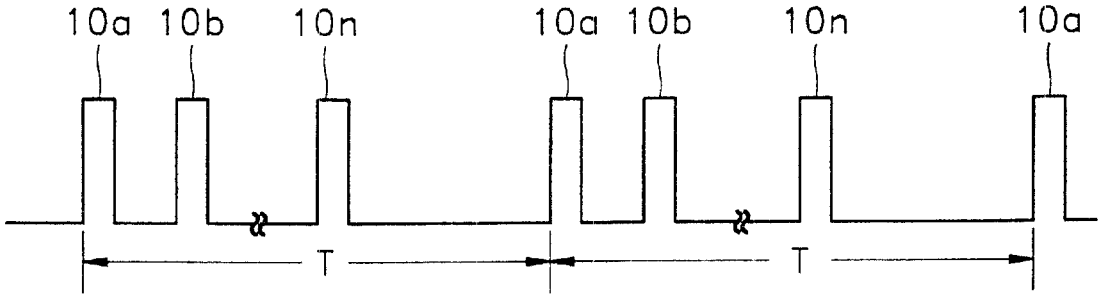
FIG. 1 (PRIOR ART)
FIG. 1 shows a mechanism for gray scale printing in an electro-mechanical transducer type ink jet printhead.

U.S. Pat. No. 4,513,299 discloses a method of gray scale printing in an electro-mechanical transducer type ink-jet printer. The method will now be described with reference to FIG. 1. Typically, ink ejection in an ink jet printhead is made by applying electrical pulses to a piezoelectric crystal or a heater. After applying a one-time electrical signal to eject a first volume of ink droplets, it takes a predetermined time to refill ink and apply an electrical signal for ejecting a second volume of ink droplets. The predetermined time is called a drive cycle. In the above patent, a desired volume of ink drops is ejected by applying a plurality of electrical drive pulses 10*a*–10*n* at short intervals within the drive cycle T to effect gray scale printing. However, there is a restriction of increasing the number of pulses applied in this manner. That is, increasing the number of pulses for increasing the number of gray levels approaches the drive cycle T. Thus, for reliable printing, the drive cycle needs to further increase.

Figure 2:
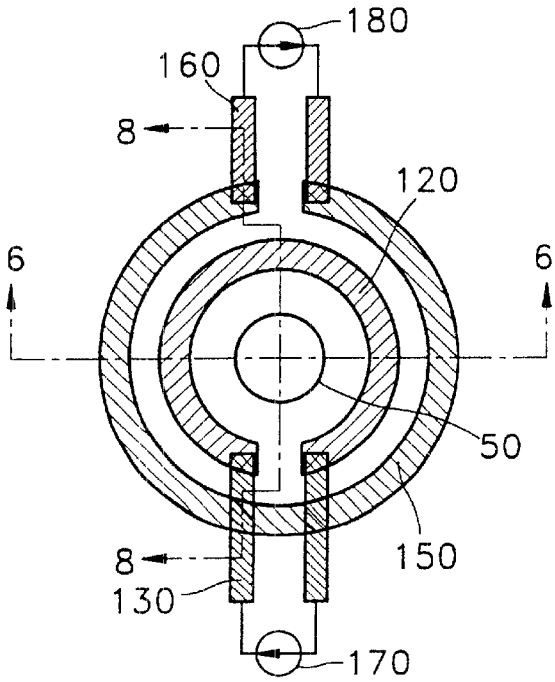
FIG. 2 illustrates a schematic top view of a bubble-jet type ink jet printhead having heater and electrode arrangements according to a first embodiment of the present invention.

Referring to FIG. 2, showing a heater according to a first embodiment of the present invention along with a nozzle, the heater includes first and second heating elements 120 and 150 arranged concentrically around a nozzle 50, and first and second electrodes 130 and 160 for supplying power from heater drive sources 170 and 180 to the first and second heating elements 120 and 150, respectively. The heating elements 120 and 150, which are typical resistive heating elements, are formed of a Ta—Al alloy or polycrystalline silicon (polysilicon) doped with impurities and substantially "C" shaped with different diameters. The first and second electrodes 130 and 160 are formed of Al or Al alloy which is typically used as an electrode material, and coupled to the ends of the corresponding heating elements 120 and 150. Although the heater drive sources 170 and 180 are shown as a current source, there is no restriction on their type if pulse current or voltage can be applied to heat the heating elements 120 and 150.

Meanwhile, although not shown in FIG. 2, the first heating element 120 and the first electrode 130, and the second heating element 150 and the second electrode 160 are electrically insulated from each other by interposing an insulating layer therebetween, respectively. The heater drive sources 170 and 180 can be independently applied to the thus-insulated first and second elements 120 and 150, respectively.

Furthermore, even though the heating elements 120 and 150 in FIG. 2 are circularly shaped, they may be formed in a polygonal shape such as a quadrangle, a pentagon, or a hexagon. This is true of a second embodiment which will later be described. Although the two heating elements 120 and 150 are shown in FIG. 2, three or more heating elements may be formed by adjusting the space or width thereof. This is true of a second embodiment of the invention which will later be described.

Figure 3:
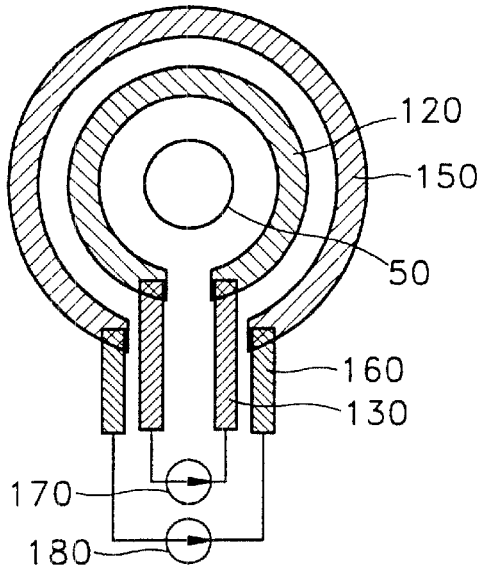
FIG. 3 illustrates a schematic top view of a bubble-jet type ink jet printhead having heater and electrode arrangements according to a second embodiment of the present invention.

Referring to FIG. 3, which is a top view showing a heater according to a second embodiment of the invention, the heater according to the invention includes two heating elements 120 and 150 which are formed in a "C" shape, and the electrodes 130 and 160. The positions of the ends of the "C"-shaped heating elements 120 and 150, and the electrodes associated therewith are different from those in the first embodiment. That is, in the first embodiment, the ends of the "C"-shaped heating elements are located at opposite positions thereby crossing the first electrodes (130 of FIG. 2) and the second heating element (150 of FIG. 2), while in the second embodiment, the "C"-shaped heating elements 120 and 150 are located in the identical directions. Thus, the heater according to the second embodiment does not need an insulating layer for insulating the first heating element 120 and the first electrodes 130 from the second heating element 150 and the second electrodes 160, unlike the first embodiment, which simplifies the manufacture thereof.

Figure 4:
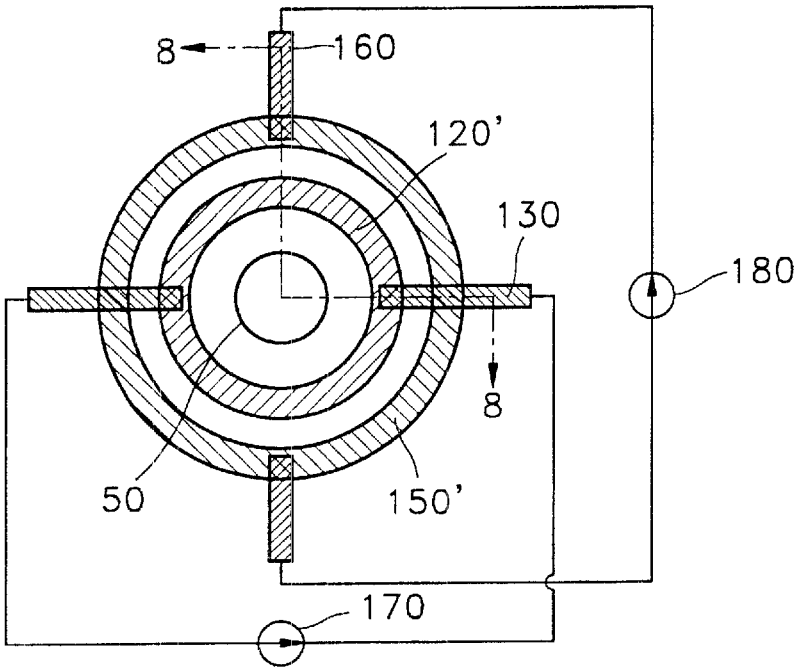
FIG. 4 illustrates a schematic top view of a bubble-jet type ink jet printhead having heater and electrode arrangements according to a third embodiment of the present invention.

Referring to FIG. 4, which is a top view showing a heater according to a third embodiment of the present invention, the heater according to the third embodiment includes two heating elements 120' and 150' arranged concentrically around a nozzle 50, and corresponding electrodes 130 and 160, like those in the first embodiment. However, the shape of the heating elements 120' and 150' and the position of the electrodes 130 and 160 are different from those in the first embodiment. The heating elements 120' and 150' are completely closed "O"-shaped, and the electrodes 130 and 160 are coupled to symmetrical positions of the heating elements 120' and 150', respectively, unlike those in the first and second embodiments as described above. As a consequence, the electrodes are coupled in serial to the heating elements in the first and second embodiments described above and a fourth embodiment to later be described, while the electrodes are coupled in parallel to the heating elements in third embodiment. Like the first embodiment, the first heating element 120' and the first electrodes 130, and the second heating element 150' and the second electrodes 160 are insulated from each other by interposing an insulating layer therebetween, respectively.

Figure 5:
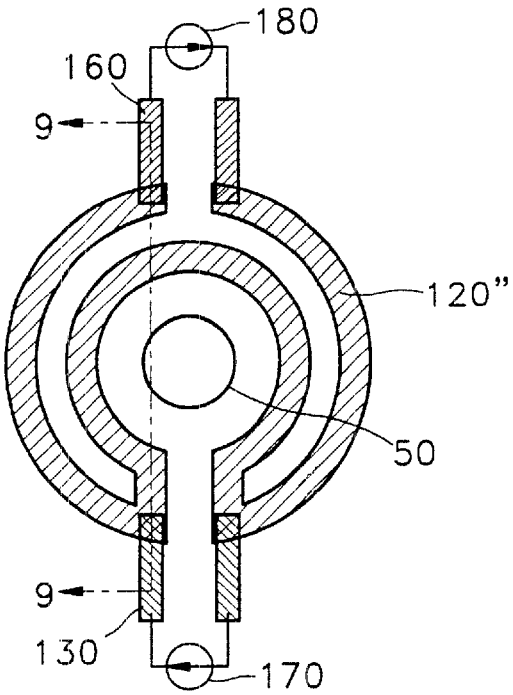
FIG. 5 illustrates a schematic top view of a bubble-jet type ink jet printhead having heater and electrode arrangements according to a fourth embodiment of the present invention.

FIG. 5 is a top view showing a heater according to a fourth embodiment of the present invention. Referring to FIG. 5, the heater according to the fourth embodiment includes the first and second heating elements (120 and 150 of FIG. 2) in the first embodiment are connected to each other to form a single heating element 120", which simplifies the manufacture of the first embodiment, as well as the second embodiment described above.

In this embodiment, if drive power is applied from the heater drive source 170 to a first electrode 130, only an internal annulus of the heating element 120" is heated, while if drive power is applied from the heater drive source 180 to the second electrode 160, the entire heating element 120" is heated.

Next, a mechanism for accomplishing gray scale printing with a heater according to the present invention will now be described. The heater according to the invention can apply to ink jet printhead having any type of an ink chamber, and hereinafter examples in which the heater applies to two types of ink jet printheads will be described.

Figure 6A:
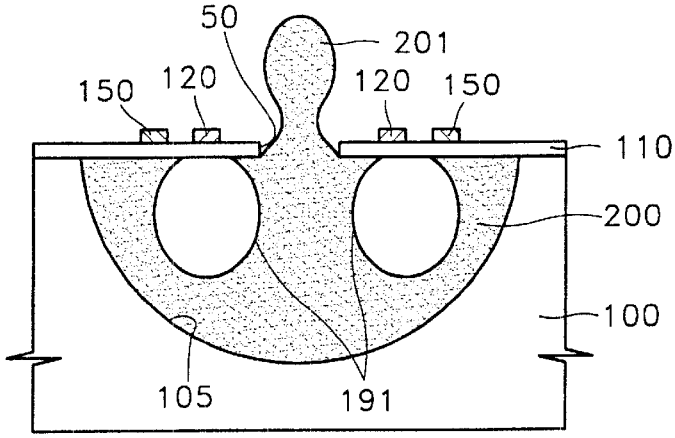
FIGS. 6A–6C illustrates one arrangement of a bubble-jet type ink jet printhead for gray scale printing wherein the embodiments of heater and electrode design of FIGS. 2–5 can be applied.
Figure 6B:
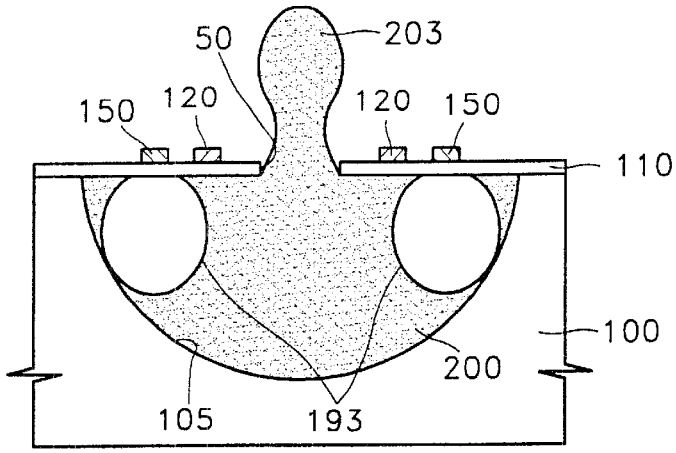
Figure 6C:
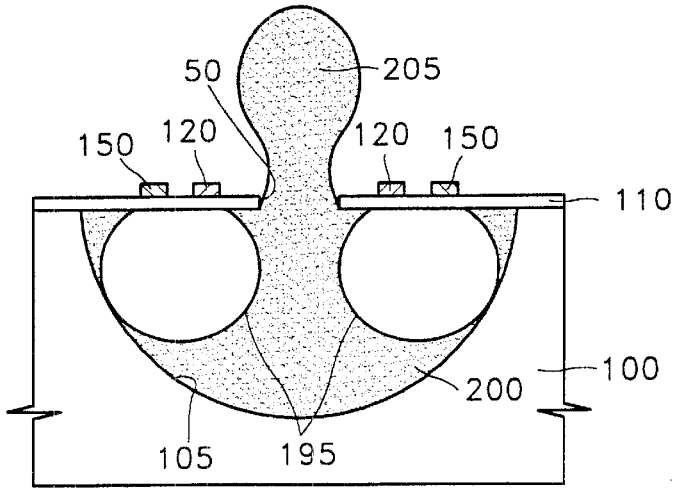

First, FIGS. 6A–6C show an example in which a heater according to the invention applies to an ink jet printhead having a hemispherical ink chamber 105 which is disclosed in the Korean Patent Application No. 2000-22260 filed by the applicant. In this example, an ink ejector is structured such that the ink chamber 105 is formed in a substantially hemispherical shape on a substrate 100, and a nozzle plate 110, in which a nozzle 50 is formed, covers the top surface of the substrate 100 and ink chamber 105. The heater according to the present invention having first and second heating elements 120 and 150 is formed on the upper surface of nozzle plate 110, or else it may be formed on the lower surface of nozzle plate 110.

FIG. 6A is a cross-sectional view showing a bubble 191 formed when heater drive power is applied only to a first heating element 120 having a small diameter and an ink droplet 201 ejected depending on the formed bubble 191, in a state in which the thus-structured ink chamber 150 is filled with ink 200. As shown, if the heater drive power is applied only to the first heating element 120, the bubble 191 is formed in a doughnut shape under the first heating element 120 conforming to the shape of the first heating element 120 in a circular shape, and a volume of ink proportional to the volume of the bubble 191 is ejected.

FIG. 6B is a cross-sectional view showing a bubble 193 formed when heater drive power is applied only to a second heating element 150 having a large diameter and an ink droplet 203 ejected depending on the formed bubble 193. As shown, if the heater drive power is applied to the second heating element 150 alone, the bubble 193 is formed in a doughnut shape under the second heating element 150, and a volume of ink proportional to the volume of the bubble 193 is ejected. Since the cross section of the bubble 193 shown in FIG. 6B is similar to that shown in FIG. 6A, but the diameter is larger than that shown in FIG. 6A, a larger volume of ink is ejected.

FIG. 6C is a cross-sectional view showing a bubble 195 formed when the heater drive power is applied to the first and second heating elements 120 and 150 and an ink droplet 205 ejected based on the formed bubble 195. Referring to FIG. 6C, if the heater drive power is applied to the first and second heating elements 120 and 150, bubbles formed under the first and second heating elements 120 and 150 coalesce to form a doughnut-shaped bubble 195 having a volume larger than the bubbles 191 and 193 shown in FIGS. 6A and 6B, thus ejecting a larger amount of ink.

Thus, if the two heating elements 120 and 150 of different diameters are provided, three gray scale levels can be accomplished. Even though this embodiment is described with reference to a mechanism for effecting gray scale printing with the two heating elements 120 and 150, if the number of heating elements of different diameters increases, more gray scale levels can be accomplished to that extent. That is, if the number of heating elements is N, $2^N$–levels of gray scale are effected according to the combinations of driving each heating element.

Figure 7A:
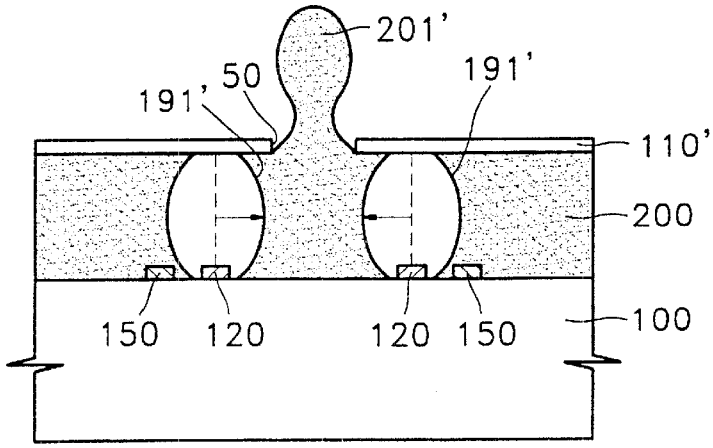
FIGS. 7A–7C illustrates a second arrangement of a bubble-jet type ink jet printhead for gray scale printing wherein the embodiments of heater and electrode design of FIGS. 2–5 can be applied.
Figure 7B:
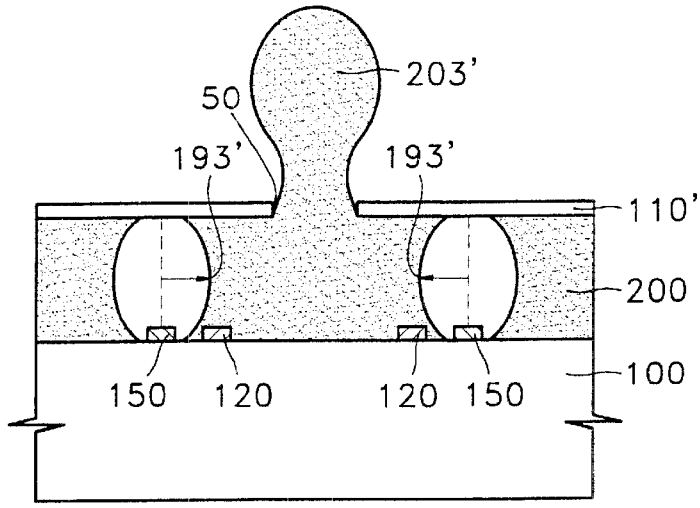
Figure 7C:
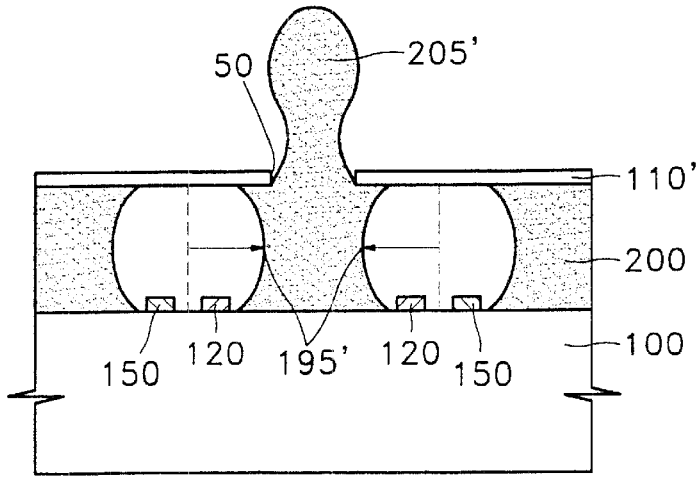

FIGS. 7A–7C shows an example in which a heater according to the present invention applies to an ink jet printhead having a structure in which a virtual ink chamber is formed by a doughnut-shaped bubble to eject an ink droplet. An ink ejector in this example is structured such that the heater according to the invention is formed on the substrate 100, the nozzle plate 110' in which the nozzle 50 is formed is located at a position corresponding to the center of the heater, and ink 200 is filled in a space between the substrate 100 and the nozzle plate 110'. The heater according to the present invention may be formed not only on the upper surface of the substrate 100 but also on the lower surface of the nozzle plate 110'.

FIG. 7A is a cross-sectional view showing a bubble 191' formed when the heater drive power is applied only to the first heating element 120 having a small diameter and an ink droplet 201' ejected depending on the formed bubble 191'. As shown, if the heater drive power is applied only to the first heating element 120, the bubble 191' is formed in a doughnut shape on the first heating element 120 to contact the lower surface of the nozzle plate 110', thereby forming a virtual ink chamber to eject a predetermined volume of ink by the formed bubble 191'.

FIG. 7B is a cross-sectional view showing a bubble 193' formed when the heater drive power is applied only to the second heating element 150 having a large diameter and an ink droplet 203' ejected depending on the formed bubble 193'. As shown, if the heater drive power is applied to the second heating element 150 alone, the bubble 193' is formed in a doughnut shape on the second heating element 150, and ink is ejected. Since the cross section of the bubble 193' shown in FIG. 7B is similar to that shown in FIG. 7A, but the diameter is larger than that shown in FIG. 7A, a larger amount of ink is ejected.

FIG. 7C is a cross-sectional view showing a bubble 195' formed when the heater drive power is applied to the first and second heating elements, and an ink droplet 205' ejected based on the formed bubble 195'. Referring to FIG. 7C, if the heater drive power is applied to the first and second heating elements 120 and 150, bubbles formed on the first and second heating elements 120 and 150 coalesce to form a doughnut-shaped bubble 195' having a volume larger than the bubbles 191' and 193' shown in FIGS. 7A and 7B. However, since the ink ejector according to this example does not have a real ink chamber, the formed bubble 195' bulges not only toward the nozzle 50 (in the direction of arrow) but also away from the nozzle 50. Thus a volume of the ejected ink is not necessarily proportional to the volume of bubble 195'. If ink of a volume corresponding to the volume of the bubble 195' bulging toward the nozzle 50 in a virtual chamber defined by the dotted center line of bubble 195' is ejected, the virtual chamber formed by the bubble 195' of FIG. 7C has a volume which is smaller than that formed by the bubble 193' of FIG. 7B, and thus the volume of ink ejected by the bubble 195' of FIG. 7C maybe smaller than that ejected by the bubble 193' of FIG. 7B. Consequentially, also in this embodiment, three levels of gray scale are accomplished by driving the two heating elements 120 and 150 selectively or in combination.

Figure 8A:
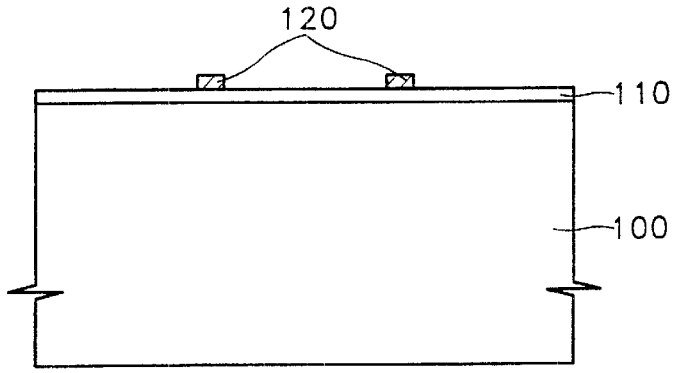
FIGS. 8A–8C are cross-sectional views showing a method of manufacturing the heater and electrode configuration for a bubble-jet type ink jet printhead according to the first and third embodiments of the present invention.
Figure 8B:
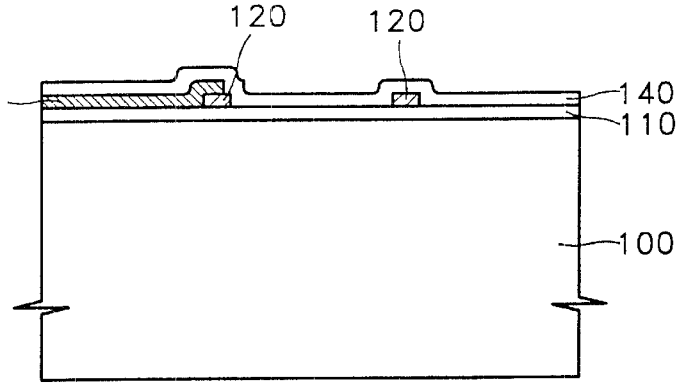
Figure 8C:
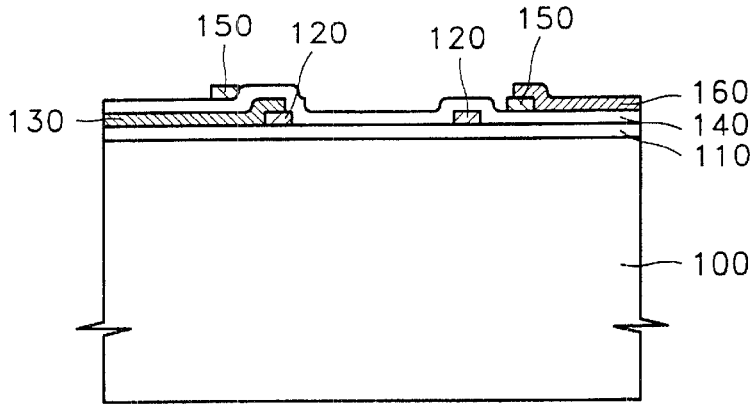

Next, a method of manufacturing a heater according to the present invention will now be described. FIGS. 8A–8C are cross-sectional views, showing methods of manufacturing the heaters according to the first and third embodiments of the present invention shown in FIGS. 2 and 4, respectively, taken along lines 6—6 and 8—8 of FIGS. 2 and 4.

First, referring to FIG. 8A, a resistive heating element is deposited over the entire surface of the nozzle plate 110 overlying the substrate 100 (in the example shown in FIGS. 7A–7C, deposited on the insulating layer overlying the substrate 100) and patterned to form the first heating element 120. The resistive heating element is formed with a Ta—Al alloy or polysilicon doped with impurities by means of sputtering or low pressure chemical vapor deposition (CVD), respectively. For this patterning, photoresist is coated on the resistive heating element, and exposed and developed using a photo mask defined in a desired shape such as a approximate "C" shape. Finally, the resistive heating element is etched using a photoresist pattern as an etching mask.

Next, referring to FIG. 8B, an electrode material is deposited over the entire surface of the nozzle plate on which the first heating element 120 has been formed, and patterned to form a first electrode 130 coupled to the first heating element 120. The electrode material is deposited with Al or Al alloy, which patterns well with good conductivity, by means of sputtering. The patterning is made in a way similar to patterning the resistive heating element as described above. Then, the insulating layer 140 is formed over the entire surface of the nozzle plate 110 on which the first heating element 120 and the first electrode 130 have been formed. If the first electrode 130 is formed by depositing a low melting point metal such as Al, the insulating layer 140 is formed of a material such as a tetraethyleorthosilicate (TEOS) oxide layer, which can be deposited at a low temperature such that the first electrode 130 is not transformed, for example, 300–400° C., by means of CVD. In this case, to reduce the overall step difference, the thickness of the insulating layer 140 is as small as possible such that the first heating element 120 and the first electrode 130, and the second heating element 150 and the second electrode 160 which will be later formed, may be insulated from each other.

Next, referring to FIG. 8C, the second heating element 150 and the second electrode 160 are formed to complete a heater in the same manner as the first heating element 120 and the first electrode 130. If the first electrode 130 is made of Al, to prevent transformation of the first electrode 130, the second heating element 150 is preferably formed of a Ta—Al alloy which can be deposited at a low temperature by sputtering as described above.

Figure 9:
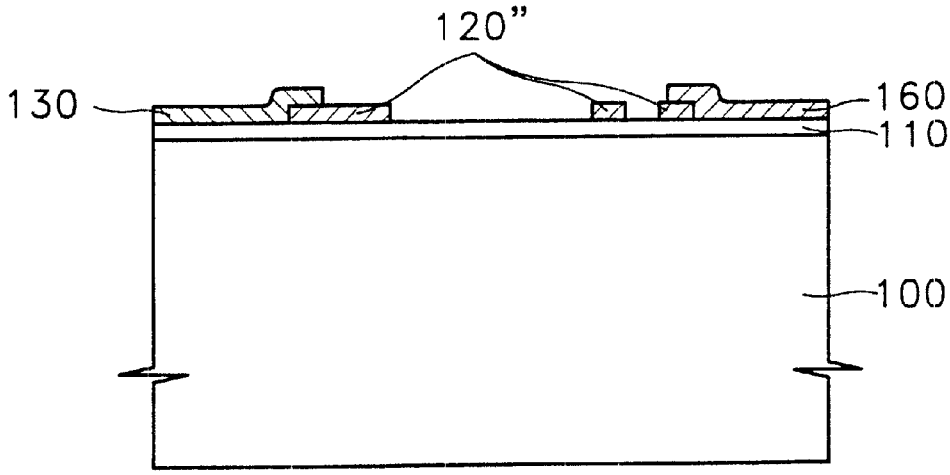
FIG. 9 is a cross-sectional view showing a method of manufacturing the heater and electrode configuration for a bubble-jet type ink jet printhead according to the fourth embodiment of the present invention.

FIG. 9 is a cross-sectional view, showing a method of manufacturing the heater according to the fourth embodiment of the present invention of FIG. 5, taken along line 9—9 of FIG. 5. Since the heating element 120" in the heater according to the fourth embodiment is connected into a single one, unlike in FIGS. 8A–8C, the heating element 120" is formed by depositing and patterning a resistive heating element once. That is, referring to FIG. 9, the resistive heating element is deposited and patterned as described above to form the heating element 120". Subsequently, the first and second electrodes 130 and 160 coupled respectively to both ends of the heating element 120" are formed simultaneously by depositing and patterning an electrode material over the entire surface of the nozzle plate 110 on which the heating element 120" has been formed. In this embodiment, since the heating element 120" is connected into a single one, the insulating layer 140 for insulating the first and second heating elements 120 and 150 is not needed unlike in FIGS. 8A–8C described above.

Similarly, the heater according to the second embodiment shown in FIG. 3 can be manufactured as shown in FIG. 9, and thus a detailed explanation will be omitted.

Although a heater according to the present invention and a manufacturing method thereof have been described with reference to specific embodiments thereof, the illustrated embodiments are only examples, and it will be apparent to one of ordinary skill in the art that modifications of the described embodiment may be made without departing from the spirit and scope of the invention. For example, in FIGS. 8A–8C, the second heating element 150 and the second electrode 160 may be formed prior to the first heating element 120 and the first electrode 130. That is, the first heating element 120 and the first electrode 130 may overlie the second heating element 150 and the second electrode 160. Furthermore, it has been shown in FIGS. 8A–9 that the heater is complete upon formation of the electrode 160, but a protective layer may be formed thereon.

As described above, a heater according to the present invention includes two or more heating elements, which are formed in the shape of polygon or circle with different diameters around a nozzle, each of the heating elements including an electrode for applying heater drive power independently, thereby allowing each heating element to be driven selectively or in combination. Thus, the volume of a bubble formed by heating a heater varies to effect various levels of gray scale with one time application of heater drive power. As a consequence, fast and simple gray scale printing can be accomplished without increasing a heater drive cycle.

Furthermore, the heater according to the present invention facilitates high volume production by a typical process of manufacturing a semiconductor device, while adopting a bubble-jet type ink jet printhead having various structures of an ink ejector.

What is claimed is:

1. A heater that produces bubbles in a bubble-jet type ink jet printhead, comprising:

a nozzle plate perforated by a nozzle hole, said nozzle hole having an outer edge;

a first heating element having an inner edge and an outer edge, said inner edge surrounding said outer edge of said nozzle hole;

a second heating element having an inner edge and an outer edge, said inner edge of said second heating element surrounding said outer edge of said first heating element; and two pairs of electrodes, each one of said two pairs being electrically connected to one of said two heating elements, respectively, wherein power can be applied selectively to only one pair of electrodes selectively heating only one of said pair of heating elements or both pairs of electrodes, producing bubbles having different volumes for each case, resulting in ink droplets of different volumes being ejected from said nozzle for each case.

2. The heater of claim 1, wherein said two heating elements are electrically insulated from one another.

3. The heater of claim 1, wherein said two heating elements are electrically connected to each other.

4. The heater of claim 3, said heater being manufactured by a process comprising the steps of:

forming said first heating element having said inner edge and said outer edge;

forming a first of said two pair of electrodes for applying heater drive power to the first heating element;

forming said second heating element having an inner edge that surrounds said outer edge of said first heater; and forming a second of said two pair of electrodes for applying heater drive power to the second heating element.

5. The heater of claim 1, wherein each of said two heating elements is of a "C" shape, said second heating element being essentially concentric with said first heating element wherein ends of the "C" shape heating elements are electrically coupled to said two pairs of electrodes, respectively.

6. The heater of claim 1, wherein each of said two heating elements are substantially "O"-shaped and concentric with each other and said outer edge of said nozzle hole, wherein diametrically opposite portions of each of said "O"-shaped heating elements are electrically coupled to said electrodes.

7. The heater of claim 1, wherein each of said two heating elements is polygonal in shape.

8. The heater of claim 1, wherein each of said two heating elements is comprised of a Ta—Al alloy.

9. The heater of claim 1, wherein each of said two heating elements is comprised of polycrystalline silicon doped with impurities.

10. A method of manufacturing a heater of a bubble-jet type ink jet printhead, comprising the steps of:

forming a first heating element having an inner edge and an outer edge;

forming a first electrode for applying heater drive power to the first heating element;

forming a second heating element having an inner edge that surrounds said outer edge of said first heater; and forming a second electrode for applying heater drive power to the second heating element.

11. The method of claim 10, between the step of forming the first electrode and the step of forming the second heating element, further comprising the step of forming an insulating layer for electrically insulating the first heating element and the first electrode from the second heating element and the second electrode.

12. The method of claim 10, forming a nozzle hole perforating a nozzle plate, said nozzle hole having an outer edge wherein an inner edge of said first heating element surrounds said outer edge of said nozzle hole.

13. The method of claim 10, wherein the steps of forming the first and second heating elements are performed at the same time, during which the first and second heating elements are formed of the same material.

14. The method of claim 13, wherein the steps of forming the first and second electrodes are performed at the same time, during which the first and second electrodes are comprised of the same material.

15. The method of claim 13, wherein the first and second heating elements are not connected to each other.

16. The method of claim 13, wherein the first and second heating elements are connected to each other.

17. The method of claim 10, wherein the first and second heating elements are comprised of a Ta—Al alloy.

18. The method of claim 10, wherein the first and second heating elements are comprised of polycrystalline silicon doped with impurities.

19. The method of claim 10, wherein the first and second electrodes are comprised of either Al or Al alloy.

20. A bubble-jet type ink jet printhead, comprising:

a nozzle plate having a nozzle hole, said nozzle hole having an outer edge;

a first heater surrounding said nozzle hole, said first heater having an outer edge;

a first pair of electrodes electrically connected to said first heater;

a second heater having an inner edge surrounding said outer edge of said first heater; and a second pair of electrodes electrically connected to said second heater, wherein different size ink droplets are ejected through said nozzle hole depending on whether power is applied to only said first pair of electrodes, only to said second pair of electrodes, or both pair of electrodes.

21. The printhead of claim 20, wherein said first heater is electrically connected to said second heater, said second heater having two ends that terminate in close proximity with each other, said second pair of electrodes being electrically connected to respective ones of said two ends of said second heater, said second heater being electrically connected to said first heater at a location diametrically opposite said nozzle hole from said second pair of electrodes, said first pair of electrodes being electrically connected to portions of said second heater that are connected to said first heater.

22. The printhead of claim 21, said printhead being manufactured by a process comprising the steps of:

forming said first heater having an inner edge and an outer edge;

forming said first pair of electrodes for applying heater drive power to said first heater;

forming said second heater having an inner edge that surrounds said outer edge of said first heater; and forming said second pair of electrodes for applying heater drive power to the second heating element.

23. The printhead of claim 20, wherein said first heater and said second heater each having a pair of ends that terminate near each other, said first pair of electrodes being electrically connected to respective ends of said first heater, said second pair of electrodes being electrically connected to respective ends of said second heater, said first and said second pair of electrodes extending away from said nozzle hole and away from said first and said second heater respectively, said first pair of electrodes disposed between said second pair of electrodes.

24. The printhead of claim 20, wherein said first heater and said first pair of electrodes are electrically insulated from said second heater and said second pair of electrodes, said first heater having an inner edge that surrounds said outer edge of said nozzle hole.

25. The printhead of claim 24, wherein said first and said second heaters are closed, respectively, said first and said second heaters being absent terminating ends.

26. The printhead of claim 25, wherein ones of said first pair of electrodes are diametrically opposite each other and ones of said second pair of electrodes are diametrically opposite each other.

27. The printhead of claim 24, wherein said first heater having a pair of terminating ends, each terminating end of said first heater being electrically connected to ones of said first pair of electrodes respectively, said second heater having a pair of terminating ends, each terminating end of said second heater being electrically connected to ones of said second pair of electrodes.

28. The printhead of claim 20, wherein said first and second heaters and said first and second pair of electrodes being disposed on a top surface of said nozzle plate.

29. The printhead of claim 28, wherein said nozzle plate is attached to a substrate, said substrate having a hemispherical cut-out for an ink chamber, said hemispherical cut-out being disposed directly beneath said nozzle hole and said first and second heaters.

30. The printhead of claim 20, wherein said first and second heaters and said first and second pair of electrodes being disposed on a bottom surface of said nozzle plate facing an ink chamber.

31. The printhead of claim 30, wherein said nozzle plate is attached to a substrate, said substrate having a hemispherical cut-out for said ink chamber, said hemispherical cut-out being disposed directly beneath said nozzle hole and said first and second heaters.

32. The printhead of claim 2, further comprising a substrate, said substrate being parallel to said nozzle plate and being separated from said nozzle plate by a predetermined distance, wherein ink flows between said substrate and said nozzle plate, said first heater, said second heater, and said first and second pair of electrodes being disposed on a top surface of said substrate facing a bottom surface of said nozzle plate.

33. A bubble-jet type ink jet printhead, comprising:

a nozzle plate being perforated by a nozzle hole, said nozzle hole having an outer edge;

a first resistive heating layer having an inner edge that surrounds said outer edge of said nozzle hole; and a second resistive heating layer having an inner edge that surrounds an outer edge of said first resistive layer, wherein power may be selectively applied to any one of said two resistive heating layers or to both resistive heating layers to generate ink droplets having a size that depends on which resistive heating layer power is applied to.

34. The printhead of claim 33, wherein the size of an expelled ink droplet from said nozzle hole depending on whether one or both resistive heating layers are being applied power simultaneously.

35. The printhead of claim 33, upon applying power any one or both of said resistive heating layers produces a doughnut-shaped bubble between a nozzle plate and a substrate forming a virtual chamber of ink underneath said nozzle hole causing ink to be expelled from said nozzle hole as said doughnut shaped bubble grows as more power is applied to one or both of said resistive heating layers.

36. The printhead of claim 35, each resistive heating layer being electrically connected to a pair of electrodes to supply power to each resistive heating layer.

37. The printhead of claim 36, said heating resistive layers and said pairs of electrodes being disposed at a bottom of an ink chamber on a top surface of said substrate facing a bottom surface of said nozzle plate.

38. The printhead of claim 36, said heating resistive layers and said pairs of electrodes being disposed at a bottom surface of said nozzle plate and at a top of an ink chamber facing a top surface of said substrate.

39. The printhead of claim 36, said heating resistive layers and said pairs of electrodes being disposed at a top surface of said nozzle plate.

* * * * *